US009109165B2

(12) United States Patent
Zimmerman et al.

(10) Patent No.: US 9,109,165 B2
(45) Date of Patent: Aug. 18, 2015

(54) COKING OF GAS OIL FROM SLURRY HYDROCRACKING

(75) Inventors: Paul R. Zimmerman, Des Plaines, IL (US); Dennis M. Clary, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 1393 days.

(21) Appl. No.: 12/271,880

(22) Filed: Nov. 15, 2008

(65) Prior Publication Data

US 2010/0122931 A1 May 20, 2010

(51) Int. Cl.

| | |
|---|---|
| ***C10G 51/04*** | (2006.01) |
| ***C10G 9/14*** | (2006.01) |
| ***C10G 49/22*** | (2006.01) |
| ***C10G 47/18*** | (2006.01) |
| ***C10G 47/20*** | (2006.01) |
| ***C10B 55/10*** | (2006.01) |
| ***C10B 55/00*** | (2006.01) |
| ***C10B 57/04*** | (2006.01) |
| ***C10G 9/00*** | (2006.01) |
| ***C10G 47/00*** | (2006.01) |
| ***C10G 69/06*** | (2006.01) |

(52) U.S. Cl.

CPC ..... *C10B 55/10* (2013.01); *C10B 55/00* (2013.01); *C10B 57/045* (2013.01); *C10G 9/005* (2013.01); *C10G 47/00* (2013.01); *C10G 69/06* (2013.01)

(58) Field of Classification Search

CPC ..... C10G 51/04; C10G 9/14; C10G 49/22; C10G 47/18; C10G 47/20

USPC ..... 208/50

See application file for complete search history.

(56) References Cited

U.S. PATENT DOCUMENTS

| | | | | | |
|---|---|---|---|---|---|
| 3,518,182 | A | * | 6/1970 | Paterson | 208/50 |
| 3,684,688 | A | * | 8/1972 | Roselius | 208/50 |
| 4,057,487 | A | * | 11/1977 | Metrailer et al. | 208/81 |
| 4,066,530 | A | * | 1/1978 | Aldridge et al. | 208/112 |
| 4,169,038 | A | | 9/1979 | Metrailer et al. | 208/20 |
| 4,178,227 | A | | 12/1979 | Metrailer et al. | 208/50 |
| 4,178,229 | A | * | 12/1979 | McConaghy et al. | 208/50 |
| 4,204,943 | A | | 5/1980 | Metrailer et al. | 208/50 |
| 4,569,751 | A | * | 2/1986 | Eidt et al. | 208/50 |
| 4,569,752 | A | * | 2/1986 | Aldridge et al. | 208/50 |
| 4,750,985 | A | * | 6/1988 | Aldridge et al. | 208/50 |
| 4,882,036 | A | * | 11/1989 | Eidt et al. | 208/50 |
| 4,954,240 | A | * | 9/1990 | Eidt et al. | 208/50 |
| 5,059,301 | A | * | 10/1991 | Roussel et al. | 208/50 |
| 5,755,955 | A | | 5/1998 | Benham et al. | 208/112 |
| 6,004,453 | A | | 12/1999 | Benham et al. | 208/108 |
| 6,171,471 | B1 | | 1/2001 | Ferrughelli et al. | 208/6 |
| 6,517,706 | B1 | | 2/2003 | Pruden et al. | 208/108 |

OTHER PUBLICATIONS

Kato, K, "Novel combination process of heavy oil cracking using disposable additive catalyst," Hungarian Chemical Society, "Additives in Petroleum Refinery and Petroleum Product [and lubricants] Formulation Practice, Additives '97" Conference (Sopron May 21-23, 1997) Proceedings 4-7 (1997).

Kato, K, "Novel combination process of heavy oil cracking using disposable additive catalyst," Hungarian Chemical Society, "Additives in Petroleum Refinery and Petroleum Product [and lubricants] Formulation Practice, Additives '97" Conference (Sopron May 21-23, 1997) Proceedings 4-7 (1997) [Abstract Only].

Poole, M. C. et al., "MICROCAT-RC(TM) upgrading option for heavy crudes and residue," AIChE 1994 Spring National Meeting (Atlanta Apr. 17-21, 1994) Preprint N.56d 14P.

Schulman, B. L. et al., "Advances in technologies for residue upgrading" Natl. Pet. Refiners Assoc. Annual Meeting (San Francisco May 19-21, 1989) Pap. N.AM-89-18 10P.

Yu, D. et al., "Coking properties of slurry-bed hydrocracked residue," ACS Division of Petroleum Chemistry, Inc. Preprints 46(3) 2001 p. 264-266, ACS 222$^{nd}$ National Meeting, 2001, Chicago, IL ISSN: 05693799.

Haizmann, Robert S. et al. "Integrated slurry hydrocracking and coking process" pending U.S. Appl. No. 12/271,851, filed Nov. 15, 2008.

Bauer, Lorenz J. et al. "Improved solids management in slurry hydroprocessing", pending U.S. Appl. No. 12/271,857, filed Nov. 15, 2008.

Haizmann, Robert S. et al. "Integrated solvent deasphalting and slurry hydrocracking process", pending U.S. Appl. No. 12/271,861, filed Nov. 15, 2008.

* cited by examiner

*Primary Examiner* — Randy Boyer

(57) ABSTRACT

Integrated slurry hydrocracking (SHC) and coking methods for making slurry hydrocracking (SHC) distillates are disclosed. Representative methods involve passing a slurry comprising a vacuum column resid, a liquid coker product, and a solid particulate through an SHC reaction zone in the presence of hydrogen to obtain the SHC distillate. Atmospheric distillation in the SHC product recovery section yields a combined SHC gas oil/SHC pitch stream that is sent to coking to generate the liquid coker product. In a representative embodiment, vacuum distillation in the SHC product recovery is avoided, thereby eliminating equipment that is often most susceptible to fouling.

18 Claims, 1 Drawing Sheet

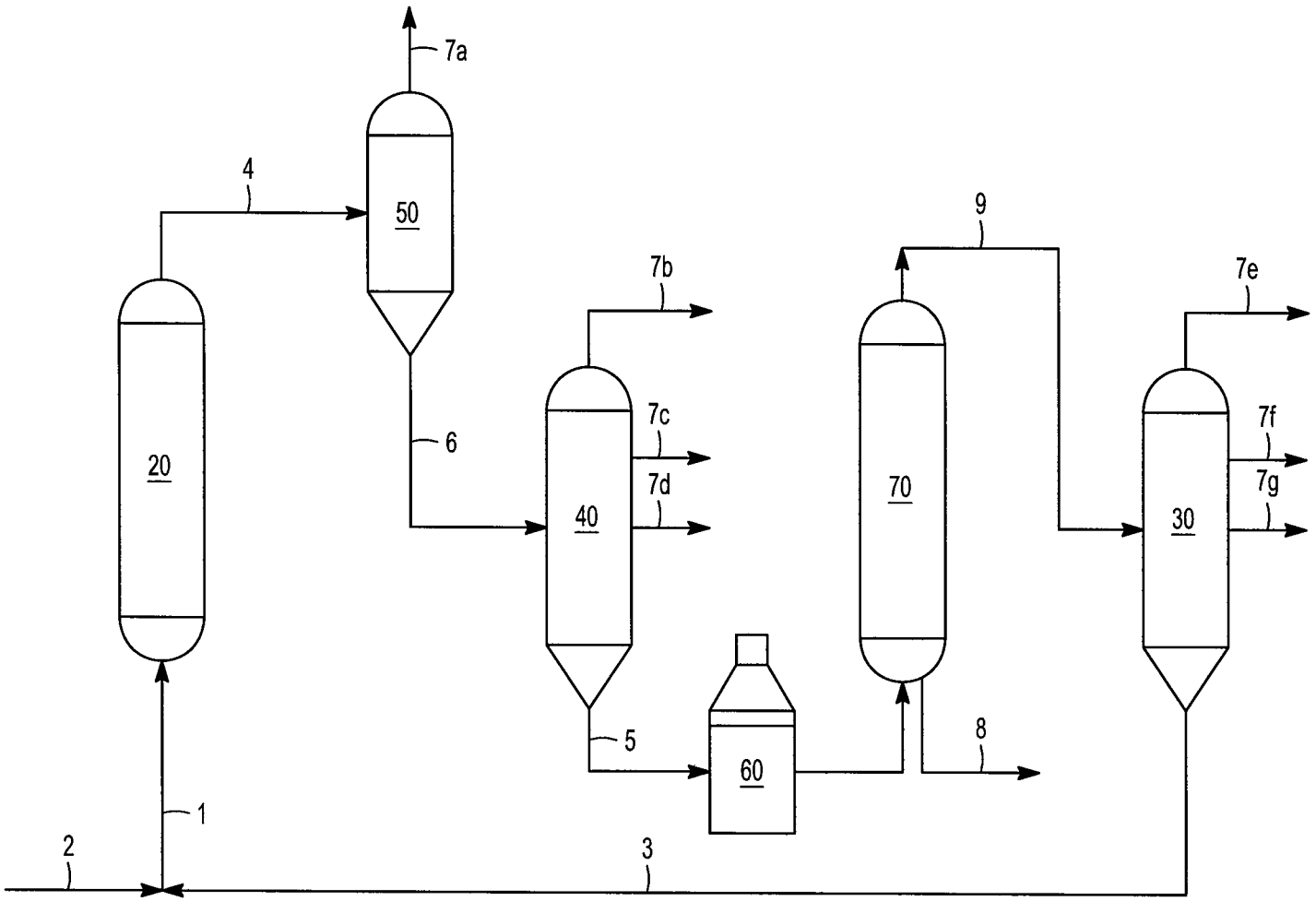
7e
7f
7g
30
9
8
70
60
7b
7c
7d
40
5
3
7a
50
6
4
20
1
2

COKING OF GAS OIL FROM SLURRY HYDROCRACKING

FIELD OF THE INVENTION

The present invention relates to methods for preparing distillate hydrocarbons using slurry hydrocracking (SHC). The heavy hydrocarbon feedstock to SHC comprises a liquid coker product, obtained from coking a liquid product (e.g., a liquid bottoms product of an SHC atmospheric distillation column) of SHC.

DESCRIPTION OF RELATED ART

Coking processes (e.g., delayed coking or fluidized coking) involve thermal (i.e., non-catalytic) cracking of atmospheric and vacuum column residues to generate lighter hydrocarbons and solid coke. See, for example, Meyers, R. A., *Handbook of Petroleum Refining Processes,* 3rd Ed., Ch. 12, McGraw-Hill (2004). Delayed coking in particular has become a predominant process for upgrading "bottom of the barrel" refinery process streams. However, the liquid products from coking operations, such as delayed coker vacuum gas oil (VGO), are regarded as low quality materials requiring further processing using fluid catalytic cracking (FCC), hydrocracking, and/or hydrotreating. Coker gas oils are unfortunately not easily processed according to such conventional methods, due to the significant levels of contaminants (e.g., metals and sulfur compounds) that deactivate supported metal catalysts, as well as coke precursors in these streams. The conversion of coker gas oils to more salable distillate and naphtha blending components for transportation fuels is therefore associated with a number of drawbacks.

Slurry hydrocracking (SHC) refers to the conversion of heavy hydrocarbon feedstocks in the presence of hydrogen and solid catalyst particles (e.g., as a metal nanoaggregate) in a slurry phase or optionally in a homogenous catalyst system using an oil-soluble metallic catalyst such as a metal sulfide compound. Representative slurry hydrocracking processes are described, for example, in U.S. Pat. No. 5,755,955 and U.S. Pat. No. 5,474,977. In addition to the gas oils (e.g., SHC VGO) normally present in the reactor effluent, slurry hydrocracking produces a low-value, refractory pitch stream that normally cannot be economically upgraded or even blended into other products such as fuel oil or synthetic crude oil, due to its high viscosity and solids content. Moreover, the gas oils and pitch made in SHC contain significant levels of asphaltenes that have a tendency to foul equipment in the SHC process and especially the product recovery section.

A particular source of synthetic crude oil of increasing interest, and for which blending components are sought to improve its flow characteristics, is bitumen. This low-quality hydrocarbonaceous material is recovered from oil sand deposits, such as those found in the vast Athabasca region of Alberta, Canada, as well as in Venezuela and the United States. Bitumen is recognized as a valuable source of "semi-solid" petroleum, which can be refined into many valuable end products including transportation fuels such as gasoline or even petrochemicals.

There is an ongoing need in the art for process in which heavy hydrocarbons (e.g., atmospheric column and vacuum column resids as well as gas oils) are converted or upgraded with improved efficiency. There is also a need for such processes in which the net production of low-value end products, including gas oils and pitch, is minimized. There is further a need for overall crude oil refining processes that include the upgrading of crude oil residues and particularly those obtained in significant proportions from heavy crude oil feedstocks.

SUMMARY OF THE INVENTION

Aspects of the invention relate to the finding that slurry hydrocracking (SHC) can be effectively integrated with coking, and optionally hydrotreating, and/or crude oil fractionation to produce one or more high value distillate streams while minimizing or even eliminating the net production of low value gas oils and pitch. SHC is generally known in the art for its ability to convert vacuum column residues to lighter products. It has now been discovered that coking (e.g., in a delayed or fluidized coker) the heavy liquid products from SHC and particularly SHC gas oils and SHC pitch provides several advantages.

For example, in an integrated SHC/coking process, these heavy liquid products may be recovered together as an SHC atmospheric distillation column bottoms product and passed to a delayed or fluidized coker. According to some embodiments of the invention, therefore, the conventional separation of SHC gas oils from an SHC pitch, recovered in combination as bottoms products from atmospheric distillation, is avoided. This obviates the need for a vacuum column and consequently its associated equipment (e.g., the vacuum column heater and reboiler), which are normally exposed to high temperature/heavy hydrocarbon service and are therefore highly susceptible to fouling.

Otherwise, it is possible to recover the heavy liquid products of SHC, as a feed to the coker, in a total liquid fraction from flash separation of the SHC reactor or reaction zone effluent in an SHC high pressure separator. In this case, even an initial separation of lower boiling hydrocarbons in the SHC effluent from SHC gas oils may be avoided. This additionally obviates the need for an atmospheric column, as well as a vacuum column. In any event, if a high content of SHC gas oils, and particularly of light gas oil (and possibly even lighter hydrocarbons), is present in the combined, SHC gas oil/SHC pitch stream (e.g., recovered as a liquid bottoms product from the SHC atmospheric distillation column or as a total liquid fraction from flash separation of the SHC reaction zone effluent), it may be desirable to remove the lighter gas oil components (e.g., those boiling below about 427° C. (800° F.)) prior to coking. This can be accomplished by vacuum flash separation of this liquid bottoms product to reduce its quantity of gas oils and retain, for example, only the heavier gas oil fractions (e.g., SHC VGO) that are subsequently coked.

Whether or not the SHC pitch-containing stream (e.g., recovered from atmospheric distillation or flash separation) is subjected to vacuum flash separation, the high Conradson carbon residue and asphaltenes in the SHC pitch make the combined SHC gas oil/SHC pitch an excellent coker feed, which converts these carbonaceous and/or asphaltenic materials largely to coke and upgraded coker naphtha and distillate products. The net production of pitch in the overall integrated process may therefore be minimized or even eliminated in favor of a net production of coke and an internal recycle of the co-produced liquid coker product. This benefits the process economics, as the SHC pitch is generally a low-value liquid product containing suspended solids, which has limited uses and often exhibits poor stability during storage and/or transportation.

In addition to solid coke, other products from coking include the liquid coker product, often recovered as the bottoms product from a coker product recovery section fractionator (e.g., an atmospheric distillation column), as well as higher-value, lower boiling hydrocarbons (e.g., distillate and/or naphtha) recovered as coker distillation (or distillate) products, which, when combined with the SHC distillate products (that make up the total SHC distillate yield), account for the overall distillate yield of the integrated SHC/coking process. The liquid coker product, obtained from coking of the combined SHC gas oil/SHC pitch stream, contains a significant amount of polar aromatic compounds (both mono-ring and multi-ring) that beneficially act as solvents of asphaltenes. Recycle of the liquid coker product back to the SHC reactor, as a component of the heavy hydrocarbon feedstock, therefore advantageously stabilizes asphaltenes in the SHC reactor or reaction zone and throughout the process. Therefore, both (i) this coker liquid product recycle to the SHC reactor and (ii) the previously discussed, combined recovery of SHC gas oil and SHC pitch (e.g., as the bottoms product of an atmospheric distillation column) may be used separately or together in an improved, integrated SHC/coking process with reduced coking.

In a representative integrated process, a crude oil vacuum column residue is utilized in combination with recycled liquid coker product, obtained from either delayed or fluidized coking, in the overall heavy hydrocarbon feedstock to SHC. Therefore, while a portion of this SHC feedstock is generally a conventional component (e.g., a vacuum column resid), the presence of a least a portion of the liquid coker product improves the SHC reactor effluent quality, particularly with respect to a reduced fouling tendency and reduced coke yield (i.e., due to the stabilization of asphaltene coke precursors), as discussed above. Moreover, liquid coker product is (i) usually readily available in large quantities, particularly in the case when the coker is operated to obtain relatively low coke yields, and (ii) difficult to further upgrade using FCC, hydrocracking, or hydrotreating due to the high levels of contaminants that poison (deactivate) catalysts used in these processes.

Aspects of the invention are therefore associated with the discovery that the liquid coker product is an attractive incremental feedstock (e.g., in combination with a vacuum column residue) which is efficiently cracked using SHC to yield lighter and more valuable net distillate and optionally naphtha products. Moreover, the integration of SHC with coking (e.g., delayed coking or fluidized coking) offers the further advantage, according to some embodiments, of passing the pitch byproduct of SHC, recovered in the bottoms product from an SHC atmospheric distillation in combination with SHC gas oil (e.g., SHC VGO), to the coker inlet, optionally together with atmospheric column or vacuum column resids that are conventionally processed in coking operations. The processing of SHC pitch in the coker thus allows for conversion/upgrading of this byproduct to higher value hydrocarbons, the recycled liquid coker product, and solid coke. The decrease in gas oil end products, such as hydrocarbons boiling in the VGO range, in the integrated SHC/coking process, diminishes the need for the separate hydrotreating and/or hydrocracking of such products.

According to one representative embodiment, an integrated SHC/coking process is combined with hydrotreating of the SHC distillate, comprising one or more of a number of distillate products. As a result of the low (or non-existent) net yield of gas oil products such as VGO, the hydrotreated distillate has a sufficiently high API gravity (e.g., at least about 20°), making it attractive for blending into a synthetic crude oil that is transported via a pipeline. Thus, the hydrotreated distillate, or even the SHC distillate without hydrotreating, may be obtained as one or a plurality of distillate products that are high quality transportation fuel blending component, with only a minor amount (e.g., less than about 20% by weight, or even less than about 10% by weight) or essentially no hydrocarbons boiling at a temperature representative of gas oils (e.g., greater than about 343° C. (650° F.)).

The SHC process may also be integrated with an existing refinery hydrotreating process, conventionally used for sulfur- and nitrogen-containing compound removal from distillates, by hydrotreating one or more recovered SHC distillate products in conjunction with a straight-run distillate obtained from crude oil fractionation and/or other refinery distillate streams. This integration may advantageously reduce overall capital costs of the complex. The integration of SHC with existing coking, optionally hydrotreating, and optionally other conventional refinery operations therefore has the potential to provide significant benefits in terms of improved processing efficiency and product yields, reduction or elimination of low-value refractory byproducts, and/or the associated capital cost reduction. According to a specific embodiment of the invention, a crude oil vacuum column bottoms residue stream provides a part of the heavy hydrocarbon feedstock to an SHC reactor, and is combined at the inlet of the SHC reactor with a liquid coker product (e.g., coker VGO). Other portions of the residue from the vacuum column or other fractions from this column, may also be processed in the coker itself. Regardless of the use of additional streams as feed to the coker, a liquid coker product or a portion of this product provides, optionally together with a straight-run gas oil (e.g., straight-run VGO), a portion of the heavy hydrocarbon feedstock processed using SHC. An SHC pitch that is separated in combination with an SHC gas oil from the SHC effluent by fractionation may be in turn passed to the coker (e.g., delayed coker or fluidized coker) for upgrading, thereby resulting in integrated processes according to the present invention with the advantages discussed herein.

These and other aspects and embodiments relating to the present invention are apparent from the following Detailed Description.

BRIEF DESCRIPTION OF THE DRAWING

FIG. 1 depicts a representative process in which slurry hydrocracking is integrated with coking to produce a SHC distillate comprising several distillate products and coke, with little or no overall production of refractory gas oils such as VGO.

DETAILED DESCRIPTION

Embodiments of the invention relate to the use of slurry hydrocracking (SHC) in combination with coking to upgrade a heavy hydrocarbon feedstock. A representative heavy hydrocarbon feedstock to the SHC comprises a liquid coker product that is obtained from coking an SHC gas oil. The liquid coker product generally comprises aromatic compounds that beneficially solubilize asphaltenes, normally present in the heavy hydrocarbon feedstock, which would otherwise have a tendency to precipitate and lead to catalyst coking and equipment fouling. A representative liquid coker product, obtained from a delayed coker or a fluidized coker, generally comprises at least about 10% by weight, typically at least about 20% by weight, and often at least about 30% by weight of aromatics.

Other components of the heavy hydrocarbon feedstock may include, as a fresh hydrocarbon feed, a refinery process stream conventionally converted using SHC. According to one embodiment, for example, the heavy hydrocarbon feedstock comprises both a vacuum column residue and the liquid coker product described above. Integration of a refinery coker operation with SHC provides important benefits with a wide range of heavy hydrocarbon feedstocks, such that integrated processes may involve processing any of a number of heavy hydrocarbon feedstock components, in addition to the liquid coker product. These components benefit from the SHC operation to decrease the overall molecular weight of the heavy hydrocarbon feedstock, and/or remove organic sulfur and nitrogen compounds and metals. According to various embodiments, SHC is improved (e.g., by the suppression of coke formation) when a significant portion of the heavy hydrocarbon feedstock boils in a representative gas oil range (e.g., from about 343° C. (650° F.) to about 566° C. (1050° F.)) and at most about 80% by weight, and often at most about 60% by weight, of the heavy hydrocarbon feedstock are compounds boiling above 566° C. (1050° F.).

In addition to liquid coker product, representative further components of the heavy hydrocarbon feedstock include residual oils such as a crude oil atmospheric distillation column residuum boiling above about 343° C. (650° F.), a crude oil vacuum distillation column residuum boiling above 566° C. (1050° F.), tars, bitumen, coal oils, and shale oils. Other asphaltene-containing materials such as whole or topped petroleum crude oils including heavy crude oils may also be used as components processed by SHC. In addition to asphaltenes, these further possible components of the heavy hydrocarbon feedstock, as well as others, generally also contain significant metallic contaminants (e.g., nickel, iron and vanadium), a high content of organic sulfur and nitrogen compounds, and a high Conradson carbon residue. The metals content of such components, for example, may be 100 ppm to 1,000 ppm by weight, the total sulfur content may range from 1% to 7% by weight, and the API gravity may range from about −5° to about 35°. The Conradson carbon residue of such components is generally at least about 5%, and is often from about 10% to about 30% by weight. Overall, many of the heavy hydrocarbon feedstock components of the SHC process, including the liquid coker product, have properties that render them detrimental to other types of catalytic conversion processes such as hydrocracking and fluid catalytic cracking. It has been found that the integrated SHC/coking processes described herein are particularly applicable for processing, as a fresh hydrocarbon component of the heavy hydrocarbon feed, residues (e.g., vacuum column resids) having a relatively low sulfur content, for example less than about 2% by weight, less than about 1% by weight, or even less than about 500 ppm by weight. Such low sulfur resids are often the most difficult to convert using SHC.

Integrated methods or processes for preparing SHC distillates generally involve passing a heavy hydrocarbon feedstock comprising the liquid coker product through an SHC reaction zone in the presence of hydrogen to provide an SHC effluent. The heavy hydrocarbon feedstock may be, but is not necessarily, present in a heterogeneous slurry catalyst system in the SHC reactor, in which the catalyst is in the form of a solid particulate. For purposes of the present disclosure, however, homogeneous catalyst systems, in which the catalytically active metal is present in the liquid phase and is dissolved in the heavy hydrocarbon feedstock (e.g., as an oil-soluble metal compound such as a metal sulfide), also fall within the definition of an SHC process, since homogeneous processes are equally applicable for upgrading the same types of heavy hydrocarbon feedstocks with the same advantageous results associated with the embodiments discussed herein.

The SHC reaction may be carried out in the presence of a combined recycle gas containing hydrogen and under conditions sufficient to crack at least a portion of the heavy hydrocarbon feedstock to a lighter-boiling SHC distillate fraction that is recovered from the effluent of the SHC reactor. A representative combined recycle gas is a mixture of a hydrogen-rich gas stream, recovered from the SHC effluent (e.g., as an overhead gas stream from a high pressure separator) and fresh make-up hydrogen that is used to replace hydrogen consumed in the SHC reactor or reaction zone and lost in any purge or vent gas streams or through dissolution. Operation without hydrogen recycle (i.e., with "once-through" hydrogen) represents an alternative mode of operation, in which a number of possible hydrogen sources of varying purity may be used.

A slurry formed with the heavy hydrocarbon feedstock is normally passed upwardly through the SHC reaction zone, with the slurry generally having a solid particulate content in the range from about 0.01% to about 10% by weight. The solid particulate is generally a compound of a catalytically active metal, or a metal in elemental form, either alone or supported on a refractory material such as an inorganic metal oxide (e.g., alumina, silica, titania, zirconia, and mixtures thereof). Other suitable refractory materials include carbon, coal, and clays. Zeolites and non-zeolitic molecular sieves are also useful as solid supports. One advantage of using a support is its ability to act as a "coke getter" or adsorbent of asphaltene precursors that, as explained above, have a tendency to foul process equipment upon precipitation.

Catalytically active metals for use in SHC include those from Group IVB, Group VB, Group VIB, Group VIIB, or Group VIII of the Periodic Table, which are incorporated in the heavy hydrocarbon feedstock in amounts effective for catalyzing desired hydrotreating and/or hydrocracking reactions to provide, for example, lower boiling hydrocarbons that may be fractionated from the SHC effluent as naphtha and/or distillate products in the substantial absence of the solid particulate. Representative metals include iron, nickel, molybdenum, vanadium, tungsten, cobalt, ruthenium, and mixtures thereof. The catalytically active metal may be present as a solid particulate in elemental form or as an organic compound or an inorganic compound such as a sulfide (e.g., iron sulfide) or other ionic compound. Metal or metal compound nanoaggregates may also be used to form the solid particulates.

Often, it is desired to form such metal compounds, as solid particulates, in situ from a catalyst precursor such as a metal sulfate (e.g., iron sulfate monohydrate) that decomposes or reacts in the SHC reaction zone environment, or in a pretreatment step, to form a desired, well-dispersed and catalytically active solid particulate (e.g., as iron sulfide). Precursors also include oil-soluble organometallic compounds containing the catalytically active metal of interest that thermally decompose to form the solid particulate (e.g., iron sulfide) having catalytic activity. Such compounds are generally highly dispersible in the heavy hydrocarbon feedstock and normally convert under pretreatment or SHC reaction zone conditions to the solid particulate that is contained in the slurry effluent. An exemplary in situ solid particulate preparation, involving pretreating the heavy hydrocarbon feedstock and precursors of the ultimately desired metal compound, is described, for example, in U.S. Pat. No. 5,474,977.

Other suitable precursors include metal oxides that may be converted to catalytically active (or more catalytically active) compounds such as metal sulfides. In a particular embodiment, a metal oxide containing mineral may be used as a precursor of a solid particulate comprising the catalytically active metal (e.g., iron sulfide) on an inorganic refractory metal oxide support (e.g., alumina). Bauxite represents a particular precursor in which conversion of iron oxide crystals contained in this mineral provides an iron sulfide catalyst as a solid particulate, where the iron sulfide after conversion is supported on the alumina that is predominantly present in the bauxite precursor.

Conditions in the SHC reactor or reaction zone generally include a temperature from about 343° C. (650° F.) to about 538° C. (1000° F.), a pressure from about 3.5 MPa (500 psig) to about 21 MPa (3000 psig), and a space velocity from about 0.1 to about 30 volumes of heavy hydrocarbon feedstock per hour per volume of said SHC zone. The catalyst and conditions used in the SHC reaction zone are suitable for upgrading the heavy hydrocarbon feedstock to provide a lower boiling component, namely an SHC distillate fraction, in the SHC effluent exiting the SHC reaction zone.

The recovery of SHC distillate typically involves the use of flash separation and/or distillation of the SHC effluent, or a lower boiling fraction or cut thereof (e.g., a fraction having a lower distillation endpoint), to separate the SHC distillate as a lower boiling component, from the co-produced (or unconverted) SHC gas oil and SHC pitch, of the SHC effluent. The SHC distillate is generally recovered from the total SHC effluent (optionally after the removal of a hydrogen-rich gas stream for recycle to the SHC reactor, as discussed above) as a fraction having a distillation end point which is normally above that of naphtha. The SHC distillate, for example, may be recovered as one or more distillate products having a distillation end point temperature typically in the range from about 204° C. (400° F.) to about 399° C. (750° F.), and often from about 260° C. (500° F.) to about 343° C. (650° F.), with heavier boiling compounds being separated into the liquid bottoms product of the SHC atmospheric distillation column, together with the SHC pitch that is used as a feedstock in downstream coking.

According to a particular embodiment, the SHC distillate and a higher-boiling SHC fraction may be recovered as an HPS vapor fraction and an HPS liquid fraction, respectively, exiting a hot high pressure separator to which the SHC effluent is fed (optionally after the removal of the hydrogen-rich gas stream). Fractionation of the higher-boiling SHC fraction (e.g., in an SHC atmospheric distillation column) can then provide the SHC gas oil and SHC pitch as a liquid bottoms product, as well as one or more distilled fractions that make up all or a part of the SHC distillate (or SHC distillate yield). The SHC distillate may therefore comprise one or more, separately recovered distillate products. These distillate products can include any hydrocarbon-containing fractions, for example the HPS vapor fraction, discussed above, obtained as a result of conversion in the SHC reactor or reaction zone. Other representative distillate products include one or more distilled fractions, such as naphtha and diesel products and their mixtures, from the SHC atmospheric distillation column. In an alternative embodiment, substantially all of the SHC effluent, except for a vapor fraction (e.g., comprising the hydrogen-rich gas stream) from a flash separator is fractionated in the SHC atmospheric distillation column. In this case, the distilled fractions in this column account for all or substantially all (e.g., at least about 90% by weight or even at least about 95% by weight) of the SHC distillate yield.

According to representative embodiments of the invention, the yield of SHC distillate (the combined amount of distillate products having a distillation end point in the ranges given above), is generally at least 30% by weight (e.g., from about 30% to about 65% by weight), normally at least about 35% by weight (e.g., from about 35% to about 55% by weight), and often at least about 40% by weight (e.g., from about 40% to about 50% by weight), of the combined SHC effluent weight (e.g., the combined weight of the recovered SHC distillate products and the SHC gas oil/SHC pitch fed to coking).

Depending on the desired end products, the SHC distillate product that is an HPS vapor fraction, as discussed above, may itself be fractionated to yield, for example, naphtha and diesel fuel having varying distillation end point temperatures. For example, a relatively light naphtha may be separated from the SHC distillate, having a distillation end point temperature from about 175° C. (347° F.) to about 193° C. (380° F.). According to other embodiments, a relatively heavy naphtha may be separated, having a distillation end point temperature from about 193° C. (380° F.) to about 204° C. (400° F.). The naphtha may be fractionated into one or more naphtha fractions, for example light naphtha, gasoline, and heavy naphtha, with representative distillation end points being in the ranges from about 138° C. (280° F.) to about 160° C. (320° F.), from about 168° C. (335° F.) to about 191° C. (375° F.), and from about 193° C. (380° F.) to about 216° C. (420° F.), respectively. Distilled fractions obtained from the SHC atmospheric distillation column may similarly have distillation end points in any of these ranges.

The one or more distillate products that are components of the SHC distillate will normally contain quantities of organic nitrogen compounds and organic sulfur compounds, with quantities varying according to the particular separation/fractionation conditions used to recover these products. For example, the amount of total sulfur, substantially present in the form of organic sulfur compounds such as alkylbenzothiophenes, in any of the distillate products may generally be from about 0.1% to about 4% by weight, normally from about 0.2% to about 2.5% by weight, and often from about 0.5% to about 2% by weight. The amount of total nitrogen in the distillate product(s), substantially present in the form of organic nitrogen compounds such as non-basic aromatic compounds including carbazoles, may normally be from about 100 ppm to about 2% by weight, and often from about 100 ppm to about 750 ppm by weight. These products will also generally contain a significant fraction of polyaromatics such as 2-ring aromatic compounds (e.g., fused aromatic rings such as naphthalene and naphthalene derivatives) as well as multi-ring aromatic compounds. According to some representative embodiments, the combined amount of 2-ring aromatic compounds and multi-ring aromatic compounds may be at least about 50% by weight in any of the recovered distillate products, whereas the amount of mono-ring aromatic compounds (e.g., benzene and benzene derivatives such as alkylaromatic compounds) typically represents only at most about 20% by weight.

The heavy hydrocarbon feedstock to the SHC reactor or reaction zone, as discussed above, often comprises a vacuum column resid, in addition to the liquid coker product (e.g., a coker fractionator bottoms product) of delayed or fluidized coking. Other representative components, as fresh hydrocarbon feeds, that may be included in the heavy hydrocarbon feedstock include gas oils such as straight-run gas oils (e.g., vacuum gas oil), recovered by fractional distillation of crude petroleum. Other gas oils produced in refineries include deasphalted gas oil and visbreaker gas oil. Whether or not these gas oils are present, the combined heavy hydrocarbon feedstock to the SHC reaction zone can be a mixture of hydrocarbons boiling in a representative gas oil range, for example from about 343° C. (650° F.) to an end point of about 593° C. (1100° F.), with other representative distillation end points being about 566° C. (1050° F.), about 538° C. (1000° F.), and about 482° C. (900° F.). A representative SHC heavy hydrocarbon feedstock containing one or more gas oils, or any of its representative gas oil components (as a fresh hydrocarbon feed), may have a distillation end point temperature from about 427° C. (800° F.) to about 538° C. (1000° F.). In the case of a straight-run vacuum gas oil, the distillation end point is governed by the crude oil vacuum fractionation column and particularly the fractionation temperature cutoff between the vacuum gas oil and vacuum column bottoms split. Thus, refinery gas oil components suitable as fresh hydrocarbon feed components of the heavy hydrocarbon feedstock to the SHC reactor, such as straight-run fractions, often result from crude oil fractionation or distillation operations, while other gas oil components are obtained following one or more hydrocarbon conversion reactions.

The SHC may be beneficially combined with hydrotreating, such that any of the recovered distillate products (e.g., a naphtha fraction and/or or a diesel fraction obtained from an SHC atmospheric distillation column) may be catalytically hydrotreated in a hydrotreating zone to reduce the content of total sulfur and/or total nitrogen. According to specific embodiments, for example, a hydrotreated naphtha fraction may be obtained having a sulfur content of less than about 30 ppm by weight, often less than about 10 ppm by weight, and in some cases even less than about 5 ppm by weight. A hydrotreated diesel fuel may be obtained having a sulfur content of less than about 50 ppm by weight, often less than about 20 ppm by weight, and in some cases even less than about 10 ppm by weight. Hydrotreating of the SHC distillate, or its distillate product components, to provide a hydrotreated distillate, may therefore provide low-sulfur products and even ultra low sulfur naphtha and diesel fractions in compliance with applicable tolerances. In preferred embodiments, any distillate product or component of the SHC distillate (or the entire SHC distillate, for example recovered as a single stream) after hydrotreating (i.e., a hydrotreated distillate) has a sufficient API gravity for incorporation into a crude oil or synthetic crude oil obtained, for example, from tar sands. Representative API gravity values are greater than about 20° (e.g., from about 25° to about 40°) and greater than about 35° (e.g., from about 40° to about 55°).

In other embodiments, integration of the SHC process with hydrotreating can involve, for example, passing an additional refinery distillate stream, such as a straight-run distillate, to the hydrotreating zone or reactor. Whether or not one or more additional streams are hydrotreated in combination with the distillate products from SHC, the hydrotreating is normally carried out in the presence of a fixed bed of hydrotreating catalyst and a combined recycle gas stream containing hydrogen. Typical hydrotreating conditions include a temperature from about 260° C. (500° F.) to about 426° C. (800° F.), a pressure from about 7.0 MPa (1000 psig) to about 21 MPa (3000 psig), and a liquid hourly space velocity (LHSV) from about 0.1 $hr^{-1}$ to about 10 $hr^{-1}$. As is understood in the art, the Liquid Hourly Space Velocity (LHSV, expressed in units of $hr^{-1}$) is the volumetric liquid flow rate over the catalyst bed divided by the bed volume and represents the equivalent number of catalyst bed volumes of liquid processed per hour. The LHSV is closely related to the inverse of the reactor residence time. Suitable hydrotreating catalysts comprise a metal selected from the group consisting of nickel, cobalt, tungsten, molybdenum, and mixtures thereof, on a refractory inorganic oxide support. Thus, integrated SHC/coking processes may additionally be integrated with crude oil fractionation columns, such that a straight-run distillate from a crude oil atmospheric distillation column is hydrotreated together one or more SHC distillate products.

As discussed above, the SHC process is advantageously integrated with refinery coking operations such as a delayed coker or a fluidized coker, wherein a liquid coker product such as coker VGO from delayed coking or fluidized coking is passed to the SHC reaction zone for upgrading, thereby beneficially solubilizing asphaltenes and suppressing coke formation in the SHC reactor. The SHC/coking integration also involves coking of the SHC pitch that is recovered together with SHC gas oil, normally as the bottoms product of atmospheric distillation in the SHC product recovery section. The feed to the coker, namely the combined SHC pitch/SHC gas oil stream, will therefore normally contain hydrocarbons with a range of boiling points characteristic of atmospheric column residues. For example, the liquid bottoms product of the SHC atmospheric distillation column may have an initial boiling point of at least about 343° C. (650° F.). In other embodiments, it may be desired to remove the lower-boiling components of the liquid bottoms product to reduce the gas oil load to the coker. One possibility is to perform a vacuum flash separation on this stream, prior to (upstream of) the coker and recovering the bottoms fraction for coking. This bottoms fraction from vacuum flash separation therefore comprises an SHC gas oil having an increased initial boiling point. For example, a representative SHC gas oil (in combination with SHC pitch), that is sent to the coker, has an initial boiling point, or distillation "front-end," temperature, in representative embodiments, of at least about 427° C. (800° F.) or at least about 454° C. (850° F.).

Embodiments of the invention therefore involve the utilization of an SHC pitch, recovered from downstream separation and/or fractionation of the SHC effluent or a higher boiling fraction or cut of this effluent (e.g., a fraction having a higher initial boiling point), as a coker feed. A typical SHC pitch stream is recovered together with SHC gas oil as a liquid bottoms product of atmospheric distillation. Exemplary embodiments of the invention are therefore directed to integrated SHC/coking processes that eliminate the conventional vacuum distillation column used to separate SHC gas oil from SHC pitch (i.e., the process is performed without a vacuum column fractionation of the SHC effluent or any SHC effluent fraction).

According to a particular embodiment, in which a higher-boiling HPS liquid fraction is recovered as a bottoms stream exiting a hot high pressure separator, atmospheric fractionation of this HPS liquid fraction, or various portions thereof (e.g., after further separation of gases such as $H_2$, $H_2S$, and light $C_1$-$C_4$ hydrocarbons) may be performed to yield one or more distillate products (e.g., naphtha, diesel fuel, other distilled fractions, or mixtures thereof). As discussed above, the liquid bottoms product from this SHC atmospheric column is the passed to the coker (e.g., delayed coker or fluidized coker) to convert the SHC pitch, thereby obtaining additional higher-value products (e.g., coker distillate products) from this SHC product, together with solid coke and the highly aromatic liquid coker product that benefits the SHC reaction. A typical SHC pitch, which may be predominantly converted to coke, will comprise or consist essentially of hydrocarbons boiling at temperatures greater than about 482° C. (900° F.), usually greater than about 538° C. (1000° F.), and often greater than about 593° C. (1100° F.). The SHC process may be operated with a moderate conversion of pitch (e.g., from about 50% to about 90%) with the remainder being coked in the coker, such that the overall pitch conversion of the integrated process is high (e.g., the overall pitch conversion is typically at least about 85%, normally at least about 90%, and often at least about 95%) or the pitch is substantially completely converted (e.g., the overall pitch conversion is at least about 98%).

Reducing the extent of pitch conversion in SHC directionally leads to a relatively greater amount of metals in the generated coke.

The present invention therefore relates to overall refinery flowschemes or processes for upgrading crude oil in the manner discussed above, and especially such overall processes wherein a liquid coker product is part of the heavy hydrocarbon feedstock to an SHC process. Due to the conversion of SHC pitch in the coker, the net products of such overall flowschemes or processes are substantially SHC distillates, coker distillates, and coke, with little or no production of low-value SHC gas oil and SHC pitch. According to representative embodiments of the invention, the yields of distillate products from both SHC and coking account for at least 80% of the overall process yields (e.g., from about 80% to about 99%), and often account for at least 85% of these yields (e.g., from about 85% to about 95%).

Further aspects of the invention relate to utilizing the SHC processes discussed above for making a synthetic crude oil or synthetic crude oil blending component. The processes involve passing a liquid coker product derived from a delayed coker or fluidized coker to an SHC process, with optional integration of the process with a hydrotreater as discussed above. Depending on the fractionation conditions used for downstream processing of the SHC effluent, an SHC distillate, comprising one or more distillate products, may be obtained having hydrocarbons essentially all boiling in the distillate range or lower. In representative embodiments, less than about 20% by weight, and often less than about 10% by weight, of the total SHC distillate and/or coker distillate are hydrocarbons boiling at a temperature of greater than 343° C. (650° F.).

A representative process flowscheme illustrating a particular embodiment for carrying out the methods described above is depicted in FIG. 1. FIG. 1 is to be understood to present an illustration of the invention and/or principles involved. As is readily apparent to one of skill in the art having knowledge of the present disclosure, methods according to various other embodiments of the invention will have configurations, components, and operating parameters determined, in part, by the specific feedstocks, products, and product quality specifications.

According to the embodiment illustrated in FIG. 1, a slurry hydrocracking (SHC) reactor or reaction zone 20 is integrated with coking. The heavy hydrocarbon feedstock 1 to this SHC reaction zone 20 is a combination of vacuum column residue stream (or resid) stream 2 and liquid coker product 3, which is the bottoms product from coker fractionator 30 of a delayed coking process. Vacuum column resid stream 2 is normally the bottoms product of a crude vacuum column or tower (not shown), typically containing hydrocarbons boiling above (i.e., having a cutpoint temperature) of about 566° C. (1050° F.). An upstream crude oil atmospheric column (not shown) generates atmospheric residue or a reduced crude stream, with a typical cutpoint temperature of about 343° C. (650° F.) that is fractionated in this crude vacuum column. Optionally, the heavy hydrocarbon feedstock 1 further includes a gas oil such as straight run vacuum gas oil (VGO) from this crude vacuum column, which, for example, contains hydrocarbons boiling in the range from about 343° C. (650° F.) to about 566° C. (1050° F.).

SHC reactor 20 is therefore utilized in an integrated manner to upgrade liquid coker product 3 from coker fractionator 30. As discussed above, liquid coker product 3 generally contains a significant quantity of aromatic hydrocarbons and therefore beneficially solubilizes asphaltenes in the heavy hydrocarbon feedstock 1, thereby suppressing coke formation in the SHC reactor 20 and fouling of SHC process equipment. The total SHC effluent stream 4 is then subjected to downstream separation/fractionation operations to recover upgraded products and a combined SHC gas oil/SHC pitch stream 5 as a liquid bottoms product of SHC atmospheric distillation column 40.

Separation/fractionation of the total SHC effluent stream 4 in a downstream product recovery section generally also involves removing a hydrogen-rich gas stream (not shown) for recycle to the SHC reactor. According to the embodiment illustrated in FIG. 1, total SHC effluent 4 is separated using hot high pressure separator (HPS) 50 to recover vapor fraction 7*a* from this flash separation, which may be, or may contain, one of a plurality (e.g., two or more) of distillate products, generally boiling in a range above that of naphtha. A higher-boiling HPS liquid fraction 6 recovered from SHC effluent 4 and in particular from the bottoms of HPS 50 is then fractionated in SHC atmospheric distillation column 40, which may yield one or more distilled SHC fractions 7*b*, 7*c*, and 7*d*, as additional distillate products that contribute to the overall yield of SHC distillate. For example, fraction 7*b* and 7*c* may be recovered as light and heavy SHC naphtha products, respectively, while fraction 7*d* may be an SHC diesel product. As discussed above, it may be possible, according to some embodiments, to eliminate SHC atmospheric distillation column 40 in favor of passing higher-boiling HPS liquid fraction 6 directly to coker heater 60 or directly to an intermediate vacuum flash separator (not shown).

Combined SHC gas oil/SHC pitch stream 5 is advantageously used as a feedstock to a delayed coker or a fluidized coker. If desired, this combined stream 5 may be subjected to a vacuum flash separation (not shown) to remove lower boiling components (e.g., light gas oil boiling below about 427° C. (800° F.) or below about 454° C. (850° F.)) to reduce its gas oil content. As shown in FIG. 1, combined SHC gas oil/SHC pitch stream 5 is passed to coker heater 60 and then to coke drum 70 from which coke 8 is generated. Coker effluent 9 is then fractionated in coker fractionator 30 to recover distilled coker fractions 7*e*, 7*f*, and 7*g* that contribute to the overall distillate yield of the integrated SHC/coking process. For example, fractions 7*e* and 7*f* may be light and heavy coker naphtha products, respectively, while stream 7*g* may be a coker diesel product.

The overall integrated process illustrated in FIG. 1 therefore produces essentially the net products of coke 8, distillate products 7*a*-7*d* from SHC, and distillate products 7*e*-7*g* from coking. Any one, or any combination of distillate products 7*a*-7*g* may be treated in a distillate hydrotreating process, for example as incremental feed streams to an existing hydrotreater processing a straight-run distillate. In this manner, a hydrotreated distillate is obtained as a product of the overall process having reduced nitrogen compound and sulfur compound impurities and/or an API gravity as discussed above that may be utilized as a blending component for synthetic crude oil.

As is apparent from this description, overall aspects of the invention are directed to the integration of slurry hydrocracking (SHC) and coking to optimize refinery operations. In view of the present disclosure, it will be seen that several advantages may be achieved and other advantageous results may be obtained. Those having skill in the art will recognize the applicability of the methods disclosed herein to any of a number of integrated SHC processes. Those having skill in the art, with the knowledge gained from the present disclosure, will recognize that various changes could be made in the above processes without departing from the scope of the present disclosure.

The invention claimed is:

1. A method for making a distillate hydrocarbon component by integrating slurry hydrocracking (SHC) and coking, the method comprising:

(a) passing a slurry comprising a crude oil vacuum column residue, a liquid coker product obtained from a delayed coker or a fluidized coker, and a solid particulate through an SHC reaction zone in the presence of hydrogen to provide an SHC effluent, (b) recovering said SHC distillate and a combination of an SHC gas oil and an SHC pitch from said SHC effluent, (c) coking said combination of said SHC gas oil and said SHC pitch in a delayed coker or a fluidized coker to provide said liquid coker product and coke.

2. The method of claim 1, wherein the SHC distillate comprises less than about 20% by weight of hydrocarbons boiling at a temperature of greater than 343° C. (650° F.).

3. The method of claim 1, wherein the overall pitch conversion of the crude oil vacuum column residue is at least about 90%.

4. An integrated process for preparing a slurry hydrocracking (SHC) distillate, the process comprising:

(a) coking an SHC gas oil to obtain a liquid coker product and coke;

(b) passing a heavy hydrocarbon feedstock comprising vacuum column residue from a crude vacuum column and at least a portion of said liquid coker product through an SHC reaction zone in the presence of hydrogen to provide an SHC effluent; and (c) recovering said SHC distillate and said SHC gas oil from said SHC effluent.

5. The process of claim 4, wherein said liquid coker product is obtained from a delayed coker or a fluidized coker.

6. The process of claim 4, wherein said liquid coker product comprises at least about 30% by weight of aromatics.

7. The process of claim 4, wherein the heavy hydrocarbon feedstock is present as a slurry, in combination with a solid particulate, in said SHC reaction zone.

8. The process of claim 7, wherein said solid particulate comprises a compound of a metal of Group IVB, Group VB, Group VIB, Group VIIB, or Group VIII.

9. The process of claim 4, wherein the overall pitch conversion of said heavy hydrocarbon feedstock is at least 90%.

10. An integrated process for preparing a slurry hydrocracking (SHC) distillate, the process comprising:

(a) coking an SHC gas oil to obtain a liquid coker product and coke;

(b) passing a heavy hydrocarbon feedstock comprising vacuum column residue and at least a portion of said liquid coker product through an SHC reaction zone in the presence of hydrogen to provide an SHC effluent; and (c) recovering said SHC gas oil from an SHC effluent in an SHC atmospheric column;

wherein an SHC distillate is recovered in one or more distillate products comprising (i) a vapor fraction from flash separation of said SHC effluent in an SHC high pressure separator, (ii) one or more distilled fractions from said SHC atmospheric distillation column, or (iii) both (i) and (ii); and said one or more distilled fractions from said atmospheric distillation column are selected from the group consisting of a naphtha product, a diesel product, or a mixture of thereof.

11. The process of claim 10, wherein said SHC gas oil is recovered in combination with an SHC pitch as a liquid bottoms product of said SHC atmospheric distillation column.

12. The process of claim 11, wherein said SHC gas oil has an initial boiling point of at least about 343° C. (650° F.).

13. The process of claim 10, further comprising hydrotreating a distillate feedstock comprising said one or more distillate products in a hydrotreating zone to obtain a hydrotreated distillate.

14. The process of claim 13, wherein said distillate feedstock further comprises, in addition to said SHC distillate, a straight-run distillate.

15. The process of claim 13, wherein said hydrotreated distillate has an API gravity of at least about 20°.

16. The process of claim 10, wherein said SHC gas oil is recovered in combination with said SHC pitch as bottoms fraction from vacuum flash separation of a liquid bottoms product of an SHC atmospheric distillation column.

17. The process of claim 10, wherein said SHC gas oil has an initial boiling point of at least about 427° C. (800° F.).

18. The process of claim 10, wherein said SHC reaction zone is maintained at a temperature from about 343° C. (650° F.) to about 538° C. (1000° F.), a pressure from about 3.5 MPa (500 psig) to about 21 MPa (3000 psig), and a space velocity from about 0.1 to about 30 volumes of heavy hydrocarbon feedstock per hour per volume of said SHC zone.

* * * * *